US009385438B2

(12) United States Patent
Wu et al.

(10) Patent No.: US 9,385,438 B2
(45) Date of Patent: Jul. 5, 2016

(54) CABLE CONNECTOR ASSEMBLY WITH SMALL OUTLINE

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/797,507

(22) Filed: Jul. 13, 2015

(65) Prior Publication Data

US 2016/0013566 A1 Jan. 14, 2016

(30) Foreign Application Priority Data

Jul. 11, 2014 (CN) ..... 2014 1 0329227

(51) Int. Cl.
*H01R 4/02* (2006.01)
*H01R 24/60* (2011.01)
*H01R 107/00* (2006.01)

(52) U.S. Cl.
CPC ..... *H01R 4/023* (2013.01); *H01R 24/60* (2013.01); *H01R 2107/00* (2013.01)

(58) Field of Classification Search
CPC ..... H01R 4/023
USPC ..... 439/660, 874
See application file for complete search history.

(56) References Cited

U.S. PATENT DOCUMENTS 7,618,293 B2 11/2009 Wu
8,100,725 B2 * 1/2012 Su ..... H01R 27/00 439/660
8,956,167 B2 * 2/2015 Wu ..... H01R 13/40 439/497

* cited by examiner

*Primary Examiner* — Tho D Ta
*Assistant Examiner* — Marcus Harcum
(74) *Attorney, Agent, or Firm* — Ming Chieh Chang; Wei Te Chung

(57) ABSTRACT

A cable connector assembly includes an insulative housing, a cable defining a number of core wires, and a number of conductive terminals held in the insulative housing. Each conductive terminal includes a contacting portion, a soldering portion soldered to the cable, and a middle portion between the contacting portion and the soldering portion. The conductive terminals include a number of first terminals in a row and a number of second terminals in another row. Both the first terminals and the second terminals include a pair of power terminals and a pair of grounding terminals. The soldering portion of only one kind conductive terminal of the first terminals is bent to a plane of the soldering portion of a corresponding conductive terminal of the second terminals with same function to form a shared soldering portion. The shared soldering portion is electrically connected to a corresponding core wire.

11 Claims, 8 Drawing Sheets

CABLE CONNECTOR ASSEMBLY WITH SMALL OUTLINE

BACKGROUND OF THE INVENTION

1. Field of the Invention

The present invention relates to a cable connector assembly, and more particularly to a structure of conductive terminals of the cable connector assembly. The instant invention relates to a copending application Ser. No. 14/698,876 filed Apr. 29, 2015 having the same applicant and the same assignee therewith.

2. Description of Related Arts

U.S. Pat. No. 7,618,293, issued on Nov. 17, 2009, shows an electrical connector including an insulative housing, an insert member inserted into the insulative housing, a first set of contacts and a second set of contacts supported in the insulative housing, a metal shell enclosing the insulative housing and the contacts, a cable having first and second sets of wires, and a substrate provided to electrically connect with the contacts. The contacts are connected at a front end of the substrate and the wires are connected at an opposite rear end thereof. The substrate increases the length of the electrical connector.

An improved cable connector assembly is desired to offer advantages over the related art.

SUMMARY OF THE INVENTION

An object of the present invention is to provide a cable connector assembly of which conductive terminals are soldered directly with a cable.

To achieve the above-mentioned object, a cable connector assembly includes an insulative housing, a cable defining a plurality of core wires, and a plurality of conductive terminals held in the insulative housing. Each conductive terminal includes a contacting portion, a soldering portion soldered to the cable, and a middle portion between the contacting portion and the soldering portion. The conductive terminals include a plurality of first terminals in a row and a plurality of second terminals in another row. Both the first terminals and the second terminals include a pair of power terminals and a pair of grounding terminals. The soldering portion of only one kind one conductive terminal of the first terminals is bent to a plane of the soldering portion of a corresponding conductive terminal of the second terminals with same function to form a shared soldering portion. The shared soldering portion is electrically connected to a corresponding core wire.

According to the present invention, the conductive terminals connect to the cable directly to do without a substrate. It thus decreases the length of the cable connector assembly.

DETAILED DESCRIPTION OF THE PREFERRED EMBODIMENT

Figure 1:
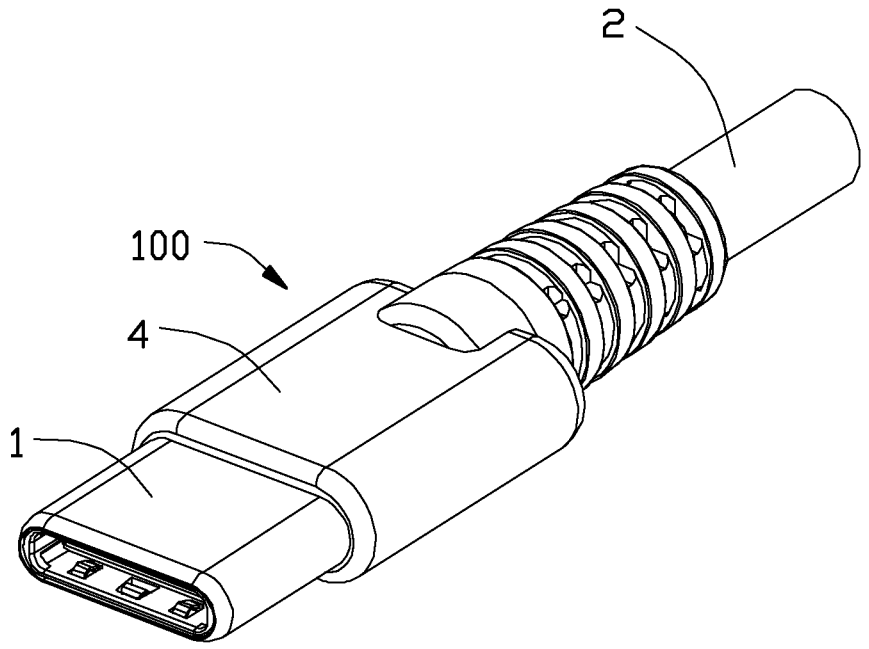
FIG. 1 is a perspective view of a cable connector assembly in accordance with the present invention.
Figure 2:
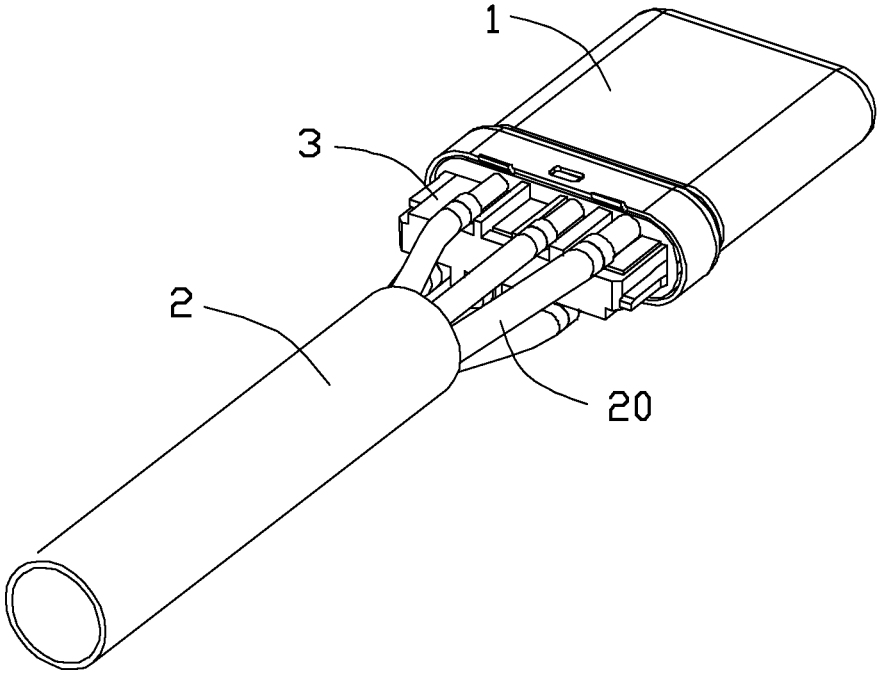
FIG. 2 is a perspective view of partly members of the cable connector assembly in accordance with the present invention.
Figure 3:
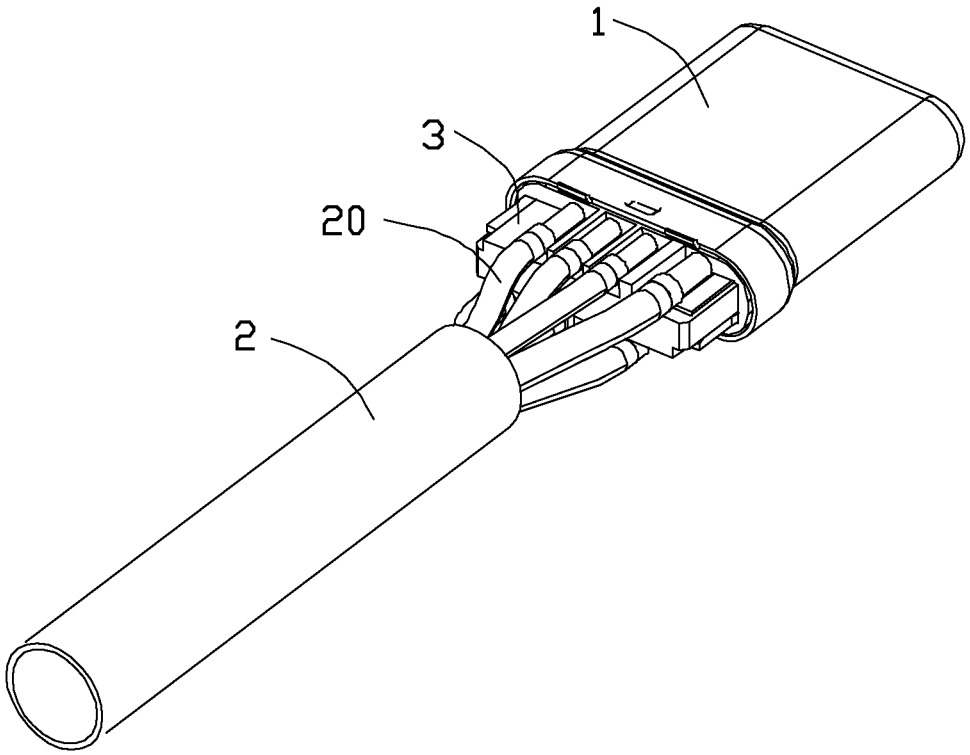
FIG. 3 is a further perspective view of partly members of the cable connector assembly as shown in FIG. 2.

Referring to FIGS. 1 to 3, a cable connector assembly 100 in accordance with the present invention for mating with a mating connector (not shown) comprises a mating member 1, a cable 2 defining a plurality of core wires 20, a spacer 3 mounted behind the mating member 1, and an outer cover 4.

Figure 6:
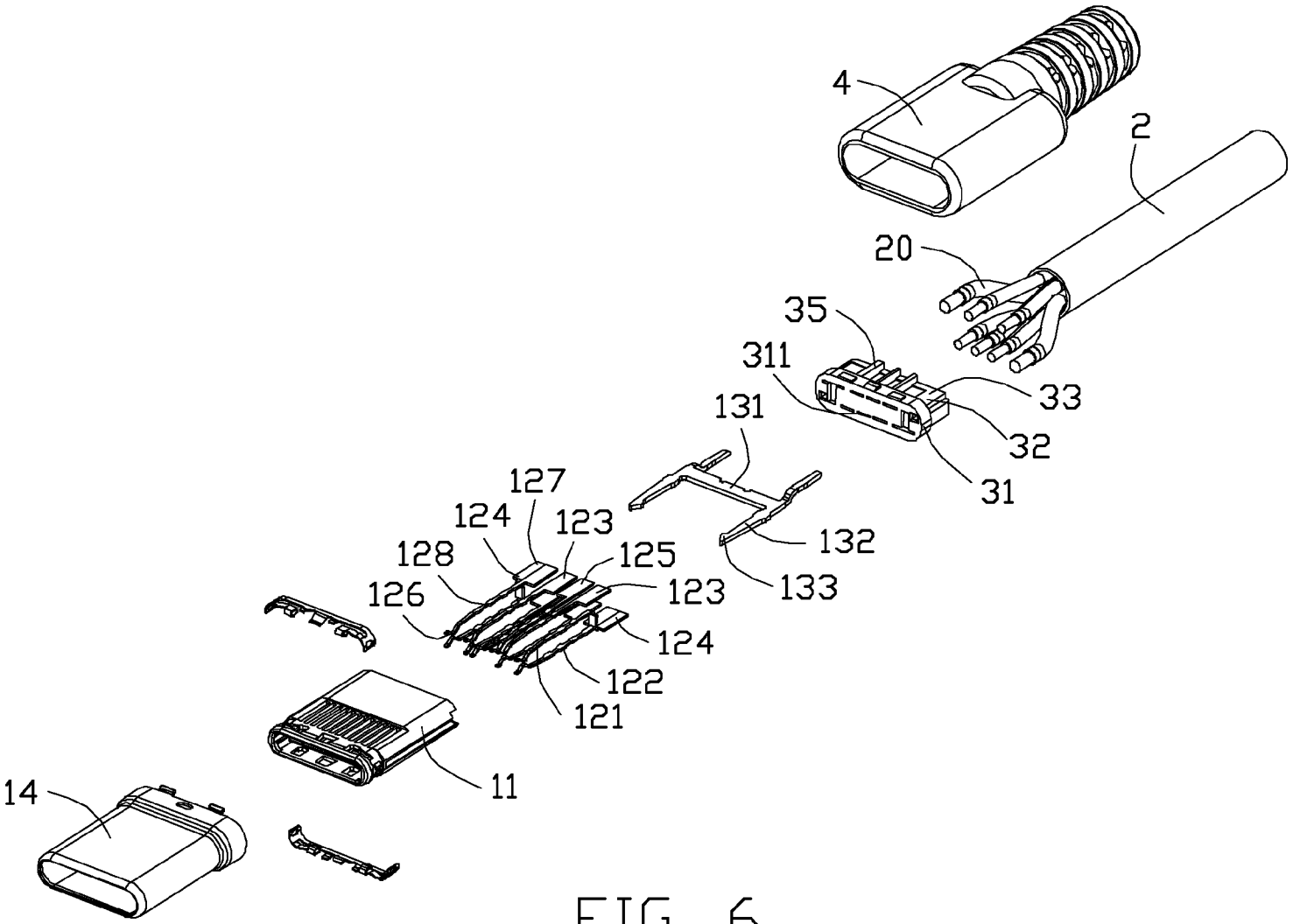
FIG. 6 is an exploded view of the cable connector assembly as shown in FIG. 2.
Figure 7:
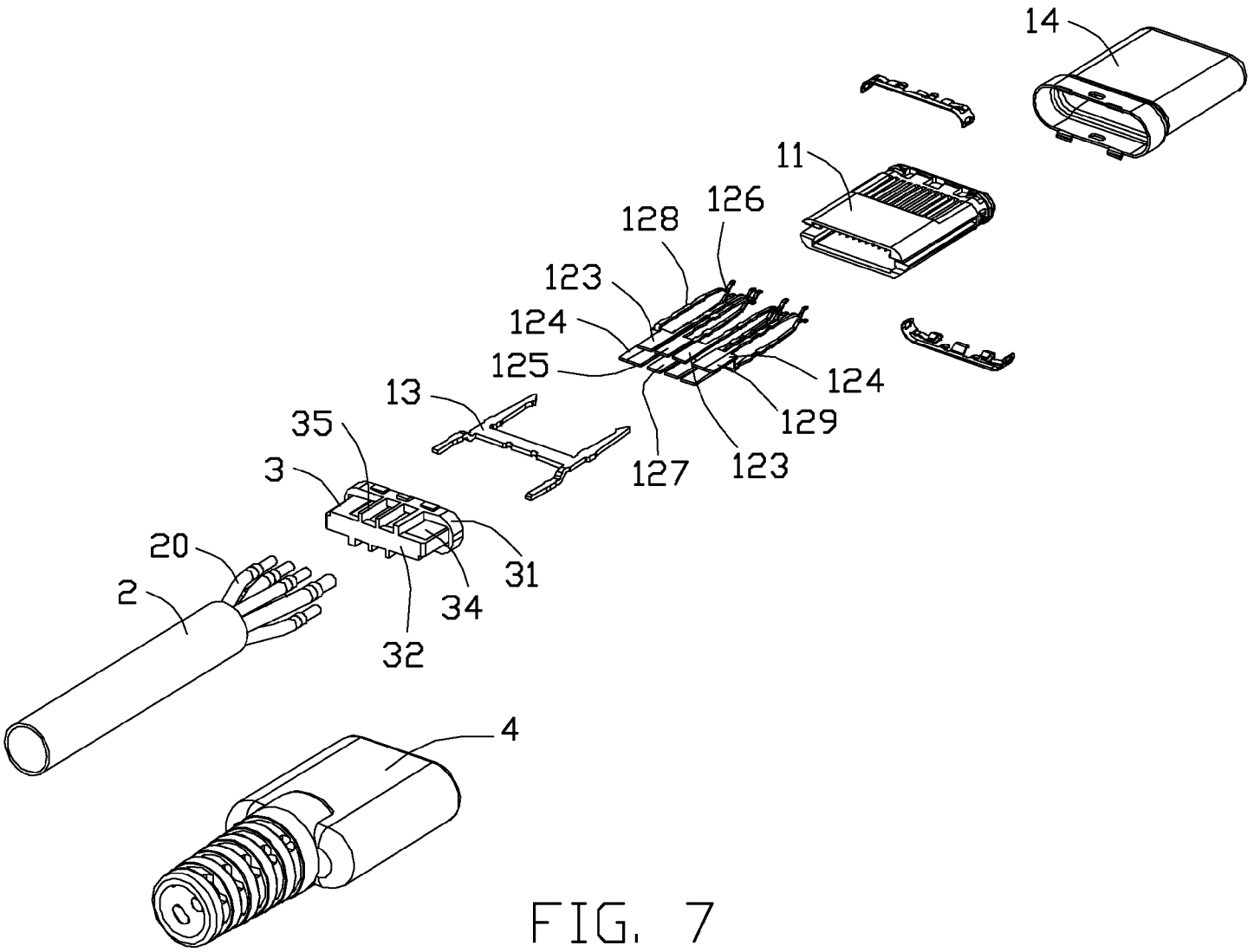
FIG. 7 is another exploded view of the cable connector assembly as shown in FIG. 2 but from a different perspective.
Figure 8:
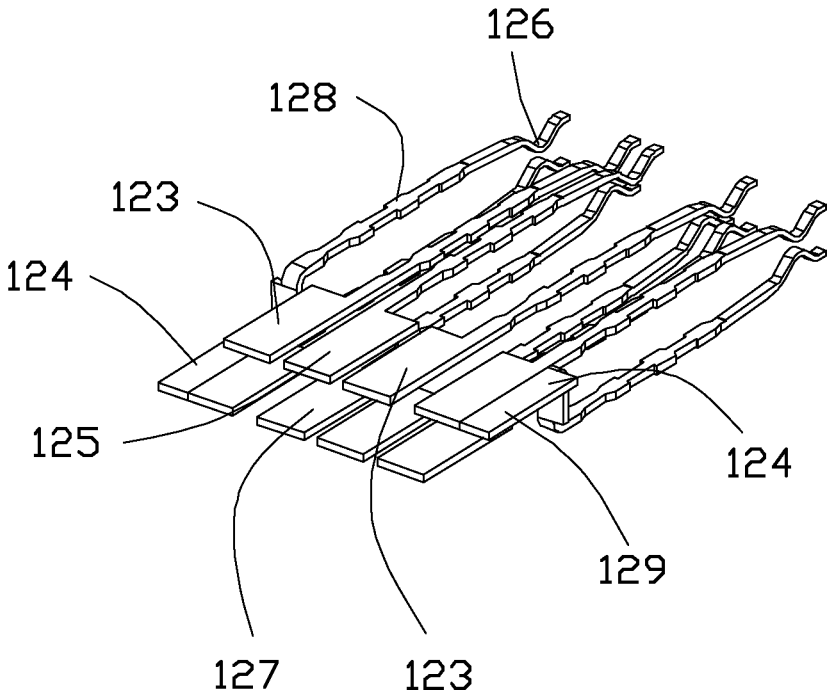
FIG. 8 is an enlarged view of the conductive terminals of the cable connector assembly as shown in FIG. 7.

Referring to FIGS. 6 to 8, the mating member 1 comprises an insulative housing 11, a plurality of conductive terminals 12 arranged in two rows spaced apart from each other in a vertical direction, a latch 13 disposed between the two rows of conductive terminals 12 for latching with the mating connector, a metal shell 14 covering the insulative housing 11, and a pair of grounding members 15 disposed on the insulative housing 11 and electrically connected to the metal shell 14.

The conductive terminals 12 comprises a plurality of first terminals 121 in a row and a plurality of second terminals 122 in another row spaced apart from the first terminals 121. Both the first terminals 121 and the second terminals 122 comprise a pair of power terminals 123, a pair of grounding terminals 124, and a control terminal 125. One of the two control terminals 125 is soldered to a core wire 20. An arrangement of the first terminals 121 is center symmetric to an arrangement of the second terminals 122.

Each conductive terminal 12 comprises a contacting portion 126 extending into the insulative housing 11 for mating with the mating connector, a soldering portion 127 extending rearwardly for soldering to the cable 2, and a middle portion 128 held in the insulative housing 11 and connecting the contacting portion 126 and the soldering portion 127. A width of the soldering portion 127 is larger than the widths of the contacting portion 126 and the middle portion 128 so that it will be convenient for the soldering portion 127 to solder with the core wire 20 directly. The contacting portions 126 of the first terminals 121 are disposed face to face with the contacting portions 126 of the second terminals 122.

The middle portions 128 of the conductive terminals 12 can be bent to align the soldering portions 127 of same kind of conductive terminals 12 in a plane of the first or second terminals. The two soldering portions 127 of the corresponding conductive terminals contact each other to form a shared soldering portion 129. The shared soldering portion 129 is electrically connected to a core wire 20 by soldering. One of the two soldering portions 127 of the shared soldering portion 129 extends rearwardly from the middle portion 128 directly, and another soldering portion 127 of the shared soldering portion 129 extends from the middle portion 127 by bending to another plane.

Figure 4:
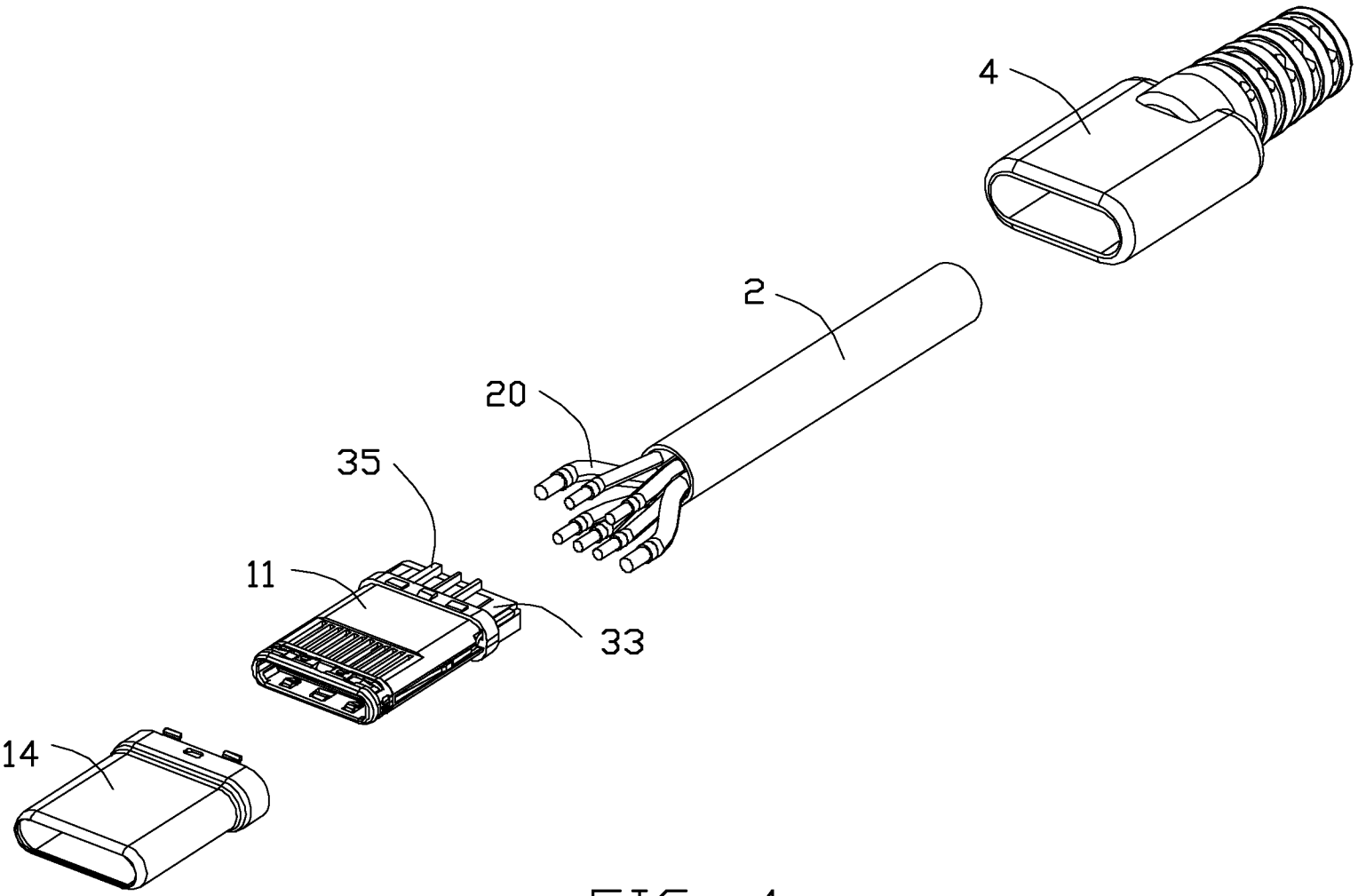
FIG. 4 is a partially exploded view of partly members of the cable connector assembly as shown in FIG. 2.
Figure 5:
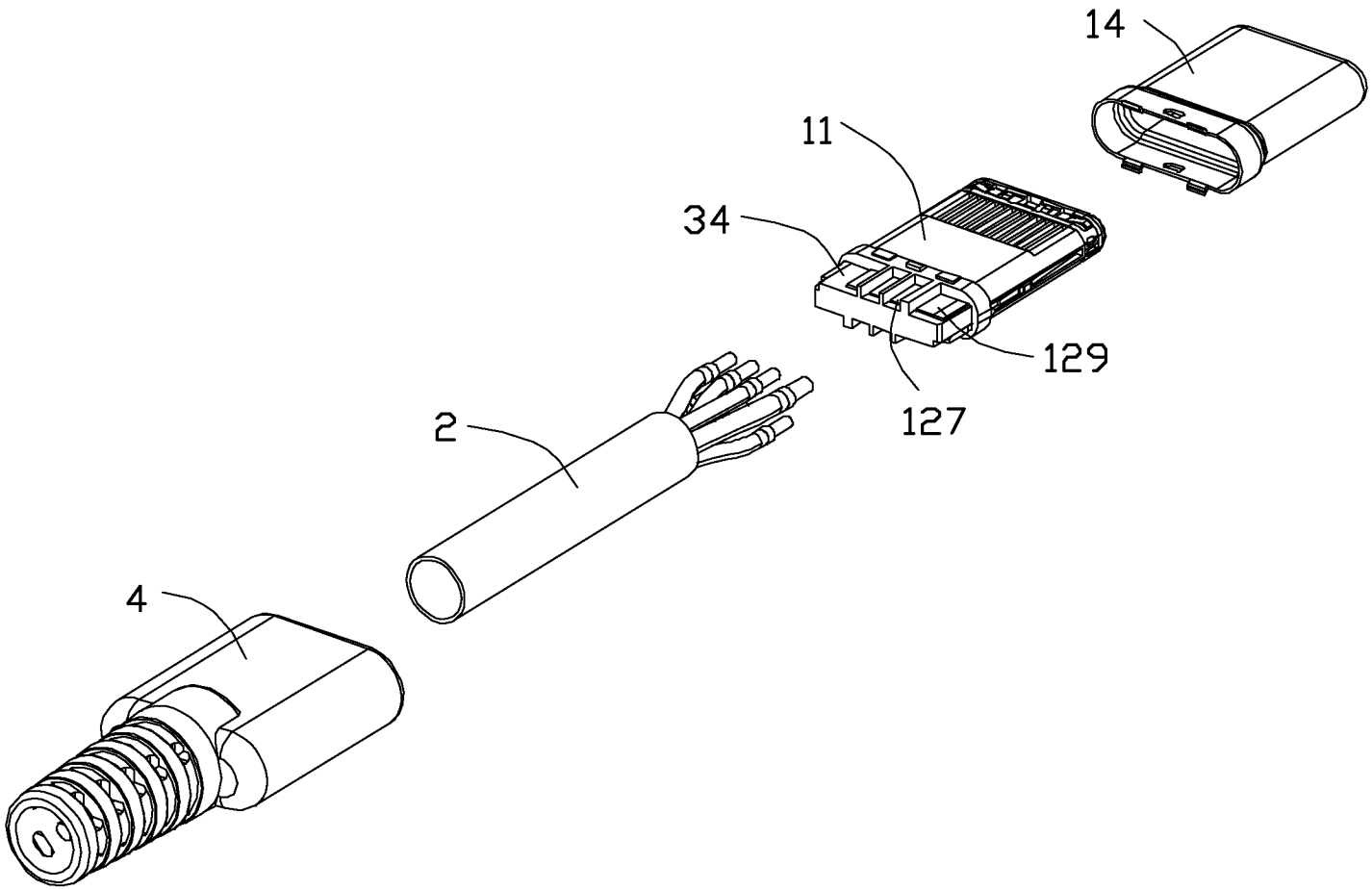
FIG. 5 is another exploded view of partly members of the cable connector assembly as shown in FIG. 2 but from a different perspective.

Referring to FIGS. 4 and 7, the two grounding terminals 124 of the first terminals 121 and the two grounding terminals 124 of the second terminals 122 are bent respectively to form two shared soldering portions 129. One of the two shared soldering portions 129 is located in a same plane with the first terminals 121, and another shared soldering portion 129 is located in a same plane with the second terminals 122. In other embodiment, the middle portion 128 of the power terminal 123 also can be bent to form shared soldering portions 129.

The latch 13 comprises a base portion 131 extending along a transverse direction, a pair of latch beams 132 respectively extending forwardly from two opposite ends of the base portion 131, and a latch portion 133 extending from a front end of each latch beam 132 along a face to face direction.

The metal shell 14 has a closed circumference to achieve a good sealing effect, a good anti-EMI performance, etc. The closed circumference of the metal shell 14 could be manufactured by drawing a metal piece, bending a metal piece, die casting, etc.

The spacer 3 comprises a first portion 31 and a second portion 32 located behind the first portion 31. The first portion 31 comprises a plurality of terminal holes 311 for passing through by the conductive terminals 12. The second portion 32 comprises an upper face 33 and a corresponding lower face 34. The soldering portions 127 of the conductive terminals 12 are disposed on the upper and lower faces 33 and 34 after passing through the terminal holes 311 to be soldered to the core wires 20. A plurality of stalls 35 are disposed on the upper and lower faces 33,34 of the second portion 32 to separate the soldering portion 127 of each conductive terminal 12. The stalls 35 are formed by extending outwardly from the upper and lower faces 33 and 34 to avoid the risk of short circuit and high-voltage.

A method of preparing the cable connector assembly 100 comprises the steps of: inserting a plurality of conductive terminals into the insulative housing 11; disposing the latch 13 between the first terminals 121 and the second terminals 122; mounting the metal shell 14 to enclose the insulative housing 11 to form the mating member 1; bending the power terminals 123 or the grounding terminals 124 to form the shared soldering portions 129; mounting the spacer 3 to the mating member 1; soldering the core wires 20 with the corresponding soldering portions 127 and the shared soldering portions 129, especially soldering one of two control terminals 125 to a core wire 20; and mounting the outer cover 4 to enclose all the components except for exposing partly the mating member 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

an insulative housing;

a cable defining a plurality of core wires; and a plurality of conductive terminals held in the insulative housing, each conductive terminal comprising a contacting portion, a soldering portion soldered to the cable, and a middle portion between the contacting portion and the soldering portion, the conductive terminals comprising a plurality of first terminals in a row and a plurality of second terminals in another row, both the first terminals and the second terminals comprising a pair of power terminals and a pair of grounding terminals, the soldering portion of only one kind conductive terminal of the first terminals bent to a plane of the soldering portion of a corresponding conductive terminal of the second terminals with same function to form a shared soldering portion, the shared soldering portion electrically connected to a corresponding core wire;

wherein the soldering portion of one grounding terminal of the first terminals bends to the plane of the second terminals to form one shared soldering portion, and the soldering portion of one grounding terminal of the second terminals bends to the plane of the first terminals to from another shared soldering portion.

2. The cable connector assembly as recited in claim 1, wherein one of the two soldering portions of the shared soldering portion extends rearwardly from the middle portion directly, and another soldering portion of the shared soldering portion extends from the middle portion and bends to lie on a same plane as the one soldering portion.

3. The cable connector assembly as recited in claim 1, wherein a width of the soldering portion is larger than the width of each contacting portion and the width of each middle portion.

4. The cable connector assembly as recited in claim 3, wherein the soldering portion of one power terminal of the first terminals bends to the plane of the second terminals to form one shared soldering portion, and the soldering portion of one power terminal of the second terminals bends to the plane of the first terminals to from another shared soldering portion.

5. The cable connector assembly as recited in claim 1, wherein an arrangement of the first terminals is center symmetric to an arrangement of the second terminals.

6. The cable connector assembly as recited in claim 1, wherein the conductive terminals comprise a control terminal soldering to a corresponding core wire.

7. The cable connector assembly as recited in claim 6, wherein both the first terminals and the second terminals comprise a control terminal, one of the two control terminals soldered to the corresponding core wire.

8. The cable connector assembly as recited in claim 1, further comprising a spacer to retain the conductive terminals, the spacer comprising an upper face and a corresponding lower face, the soldering portions of the conductive terminals disposed on the upper and lower faces.

9. The cable connector assembly as recited in claim 8, wherein a plurality of stalls are disposed on the upper and lower faces to separate the soldering portions of the conductive terminals.

10. A cable connector assembly comprising:

an insulative housing defining a mating cavity communicating with an exterior along a front-to-back direction;

a plurality of terminals disposed in the housing and arranged in first and second rows each extending along a transverse direction perpendicular to the front-to-back direction and opposite to each other in a vertical direction perpendicular to both the front-to-back direction and said vertical direction;

the mating cavity defining opposite first and second transverse ends in said transverse direction;

a spacer attached to a rear side of the housing in said front-to-back direction;

each of said terminals including a front contacting section extending into the mating cavity, and a rear soldering section positioned upon the spacer;

said terminals including grounding terminals, power terminals and control terminals, and the terminals in each of said first and second rows being arranged with the grounding terminal, the power terminal, the control terminal, the power terminal and the grounding terminal in sequence along the transverse direction;

the soldering section of the grounding terminal in the first row at the first transverse end extending toward the second row to be joined and essentially coplanar with the soldering section of the grounding terminal in the second row;

the soldering section of the grounding terminal in the second row at the second transverse end extending toward the first row to be joined and essentially coplanar with the soldering section of the grounding terminal in the first row;

a cable including a plurality of wires soldered to the soldering sections of the terminals, respectively; wherein along the transverse direction from the first transverse end to the second transverse end, the soldering sections exposed upon the spacer in the first row are the soldering section of the power terminal, the soldering section of the control terminal, the soldering section of the power terminal and the joined soldering sections of the corresponding grounding terminals while the soldering sections exposed upon the spacer in the second row are the joined soldering sections of the corresponding grounding terminals, the soldering section of the power terminal, the soldering section of the control terminal, and the soldering section of the power terminal.

11. The cable connector assembly as claimed in claim 10, wherein the wires soldered to the corresponding soldering sections of the power terminals in the second row, is separated from each other by another wire which is soldering upon the soldering section of the control terminal.

* * * * *